US005706789A

United States Patent [19]

Yamada et al.

[11] Patent Number: 5,706,789

[45] Date of Patent: Jan. 13, 1998

[54] VAPORIZED FUEL CONTROL APPARATUS AND A CONTROL METHOD OF THE SAME IN AN INTERNAL COMBUSTION ENGINE

[75] Inventors: Jun Yamada; Kenji Kanehara, both of Nishio, Japan

[73] Assignee: Nippon Soken, Inc., Nishio, Japan

[21] Appl. No.: 784,904

[22] Filed: Jan. 16, 1997

[30] Foreign Application Priority Data

Jan. 17, 1996 [JP] Japan ..... 8-005825

[51] Int. Cl.[6] ..... F02M 33/02

[52] U.S. Cl. ..... 123/520

[58] Field of Search ..... 123/516, 518, 123/519, 520

[56] References Cited

U.S. PATENT DOCUMENTS

| | | | |
|---|---|---|---|
| 5,088,466 | 2/1992 | Tada | 123/519 |
| 5,323,751 | 6/1994 | Osanai et al. | 123/520 |
| 5,355,862 | 10/1994 | Muramatsu et al. | 123/520 |
| 5,426,938 | 6/1995 | Ogawa et al. | 123/520 |
| 5,572,980 | 11/1996 | Nakagawa et al. | 123/520 |
| 5,606,955 | 3/1997 | Yuda | 123/520 |
| 5,634,451 | 6/1997 | Tomisawa | 123/520 |

OTHER PUBLICATIONS

English Abstracts of Eiji et al Application No.04–124450.
English Abstracts of Norio Application No. 61–019962.

*Primary Examiner*—Thomas N. Moulis
*Attorney, Agent, or Firm*—Cushman, Darby & Cushman IP Group of Pillsbury Madison & Sutro LLP

[57] ABSTRACT

A vaporized fuel control apparatus according to the present invention is provided in an internal-combustion engine at least including a plurality of cylinders and each cylinder having a fuel injector, an intake tube mounted to the cylinders, a fuel tank, and a canister connected to the fuel tank. The vaporized fuel control apparatus includes a purge valve and an electronic control unit for controlling the opening/closing of the purge valve. The purge valve is provided in a purge passage connected between the canister and intake tube, the canister being filled by an absorbing material to absorb a fuel vaporized from the fuel tank. The electronic control unit controls an amount of purged gas flowing into the intake tube by controlling the opening/closing timing and the duty ratio of the purge valve in such a way that the purge valve is opened at a timing when a stroke of a particular cylinder reaches the same stroke at a next cycle in synchronization with an engine rotational speed, and an amount of the fuel supplied to the particular cylinder is reduced in accordance with an amount corresponding to an inflow amount of the purged gas.

7 Claims, 8 Drawing Sheets

VAPORIZED FUEL CONTROL APPARATUS AND A CONTROL METHOD OF THE SAME IN AN INTERNAL COMBUSTION ENGINE

BACKGROUND OF THE INVENTION

1. Field of the Invention

The present invention relates to a vaporized fuel control apparatus and a control method of the same in an internal-combustion engine. Particularly, it relates to a vaporized fuel control apparatus for suppressing discharge of the vaporized fuel into the external air by purging the vaporized fuel into the intake air so that fluctuation of an air-to-fuel ratio can be suppressed at the time of the purging operation.

2. Description of the Related Art

As one example, a conventional vaporized fuel control apparatus in an internal-combustion engine has been disclosed in the Japanese Unexamined Patent Publication No. 61-19962 ("a purge control apparatus for vaporized fuel gas"). According to this document, a purge valve, such as an electromagnetic valve, which is used for controlling an amount of the purged gas flowing to an intake tube, is provided in a purge passage which couples a canister for temporarily accumulating the vaporized fuel gas and a purge port which is opened to an air intake port of an intake tube.

In this structure, the purge valve is opened or closed in response to a pulse current having constant frequency (for example, 10 Hz). An amount of purged gas is controlled by adjusting a duty ratio which is determined by opened/closed time of the purge valve so that an operating state of the internal-combustion engine can be maintained normally.

However, when the opening/closing of the purge valve is controlled in response to the constant frequency, it is very difficult to precisely control the duty ratio in response to various driving circumstances so that, for example, the air-to-fuel ratio fluctuates due to the change of amount to be purged as explained in detail below.

SUMMARY OF THE INVENTION

The primary object of the present invention is to provide a vaporized fuel control apparatus in an internal-combustion engine enabling optimum control of the purged gas by precisely adjusting the duty ratio of opening/closing of the purge valve in synchronization with an engine rotational speed.

Another object of tile present invention is to provide a control method of the vaporized fuel in an internal-combustion engine enabling optimum control of the purged gas by precisely adjusting the duty ratio of opening/closing of the purge valve in synchronization with an engine rotational speed.

In accordance with one aspect of the present invention, there is provided a vaporized fuel control apparatus in an internal-combustion engine at least including a plurality of cylinders and each cylinder having a fuel injector, an intake tube mounted to the cylinders, a fuel tank, and a canister connected to the fuel tank, including:

- a purge valve provided on the way of a purge passage connected between the canister and intake tube, and the canister being filled by an absorbing material to absorb a fuel vaporized from the fuel tank, and
- a control unit, preferably, an electronic control unit, for controlling an amount of purged gas flowing into the intake tube by controlling opening/closing timing and a duty ratio of the purge valve in such a way that the purge valve is opened at a timing when a stroke of a particular cylinder reaches the same stroke at a next cycle in synchronization with an engine rotational speed, and a supply amount of fuel to the particular cylinder is reduced in accordance with an amount corresponding to an inflow amount of the purged gas.

In a preferred embodiment, the duty ratio is controlled so as to provide an optimum inflow amount of the purged gas.

In another preferred embodiment, the cylinders are formed as four cylinders #1 to #4, and the particular cylinder is defined either as the cylinder #1 or as the cylinders #1 and #3.

In still another preferred embodiment, the stroke is defined as an absorption stroke.

In accordance with another aspect of the present invention, there is provided a method for controlling vaporized fuel in an internal-combustion engine at least including a plurality of cylinders and each cylinder having a fuel injector, an intake tube mounted to the cylinders, a fuel tank, and a canister connected to the fuel tank, including the steps of:

- providing a control unit, preferably an electronic control unit, for controlling an amount of purged gas flowing into the intake tube by controlling opening/closing timing and a duty ratio of the purge valve; and
- controlling the purge valve by the control unit in such a way that the purge valve is opened at a timing when a stroke of a particular cylinder reaches the same stroke at a next cycle in synchronization with an engine rotational speed, and a supply amount of fuel to the particular cylinder is reduced in accordance with an amount corresponding to an inflow amount of said purged gas.

DESCRIPTION OF THE PREFERRED EMBODIMENT

Figure 1:
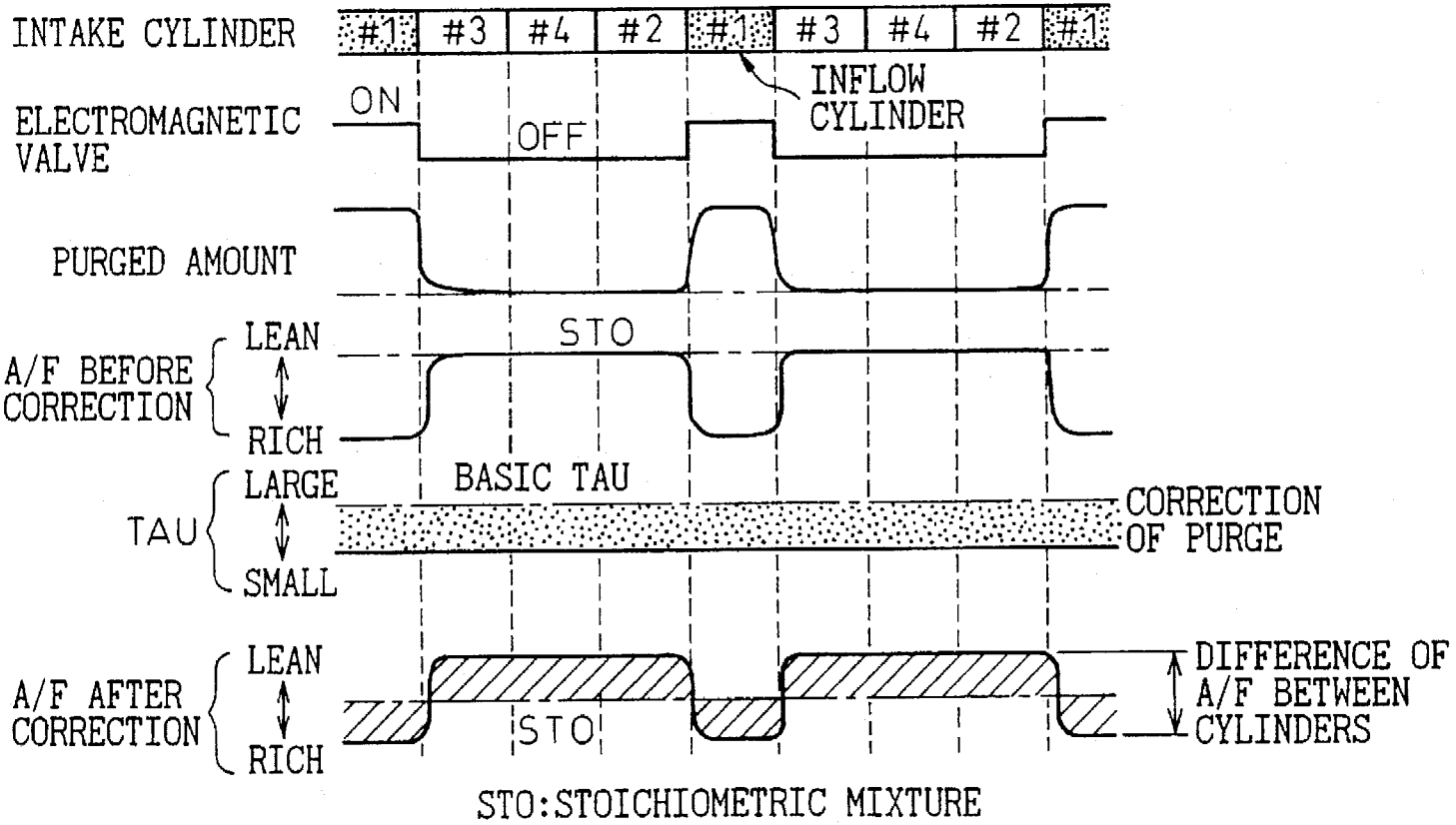
FIG. 1 is a control chart for explaining one example of the operation which is considered as a conventional art.

Before describing preferred embodiments, the operation which is considered as a conventional art and its problems will be explained, in detail, with reference to the drawing.

FIG. 1 is a control chart for explaining one example of the operation which is considered as a conventional art. In the drawing, TAU denotes a basic fuel injecting amount, A/F denotes air-to-fuel, and ST0 denotes a stoichiometric mixture ratio. Further, #1 to #4 denote cylinders, and ON/OFF denotes opening/closing of the electromagnetic valve (i.e., a purge valve).

In the cylinders #1 to #4, when the purge valve is turned on/off at a constant frequency, the purged gas flows into only the particular cylinder as shown by the cylinder #1 when the engine rotational speed reaches a certain value. As a result, the purged amount is one-sided to the particular cylinder, i.e., the cylinder #1, so that the air-to-fuel ratio becomes "rich" before correction of the A/F ratio.

Accordingly, if the purged amount is corrected so that an average value of the A/F ratio of each cylinder becomes the stoichiometric mixture ratio, the A/F ratio is changed following the period of on/off of the purge valve (see A/F AFTER CORRECTION in the drawing) so that the difference of the A/F ratio occurs among cylinders.

On the other hand, because of an environmental problem, a size of the canister tends to be large in order to avoid the discharge of the vaporized fuel into the external air as much as possible. However, when the size becomes large, the purged amount of the vaporized fuel from the canister is increased during driving. Accordingly, in this situation, when the purged amount is one-sided to the particular cylinder as mentioned above, this one-sided purged amount results in misfiring of an engine, the increase of emission of an exhaust gas, etc.

As another example, a conventional vaporized fuel control apparatus in an internal-combustion engine has been disclosed in the Japanese Unexamined Patent Publication No. 4-72453. According to this document, a purge ratio indicating a ratio of the purged amount and the intake air amount is defined, and the duty ratio of the purge valve is adjusted in accordance with a ratio of a maximum purge ratio and an actual purge ratio.

However, according to this method, since the purged gas is supplied to the intake cylinder at a constant period, the cylinder into which the purged gas is taken is different according to the engine rotational speed so that the A/F ratio fluctuates with the cylinder. On the other hand, since the fuel compensated by the purged gas is corrected by uniformly reducing the fuel injecting amount of all cylinders, the fluctuation of the A/F ratio with the cylinder occurs even if the average A/F ratio becomes the stoichiometric mixture ratio. Accordingly, the larger the purged amount, the larger the fluctuation of the A/F ratio. As a result, as mentioned above, the one-sided purged amount results in misfiring of the engine, an increase in emission of an exhaust gas, etc.

As still another example, a conventional vaporized fuel control apparatus in an internal-combustion engine has been disclosed in the Japanese Unexamined Patent Publication No. 4-124450. According to this document, the timing of opening/closing of the purge valve is adjusted to the timing of opening of the intake valve in each cylinder so that an amount of the vapor absorbed by each cylinder becomes the same.

In this case, as mentioned above, when the canister becomes large so that the purged amount of the vapor is increased, a size of the purge valve also becomes large in order to ensure the amount to be purged. However, when the purge valve becomes large, the opening/closing response of the purge valve itself become slow so that it is difficult to precisely follow to the intake stroke in each cylinder. Therefore, according to this document, it is difficult to precisely control the duty ratio of the purge valve when the engine is rotated at high speed.

Therefore, briefly, the present invention aims to solve the above-mentioned problems by performing the following operations, i.e., the purge valve is turned on/off in synchronization with the engine rotational speed, the purge valve is opened at the time when the particular cylinder takes the same stroke position at the next cycle, and the opening period of the purge valve (i.e., duty ratio of the purge valve) is controlled so as to send the optimum purged gas to the intake passage.

Figure 2:
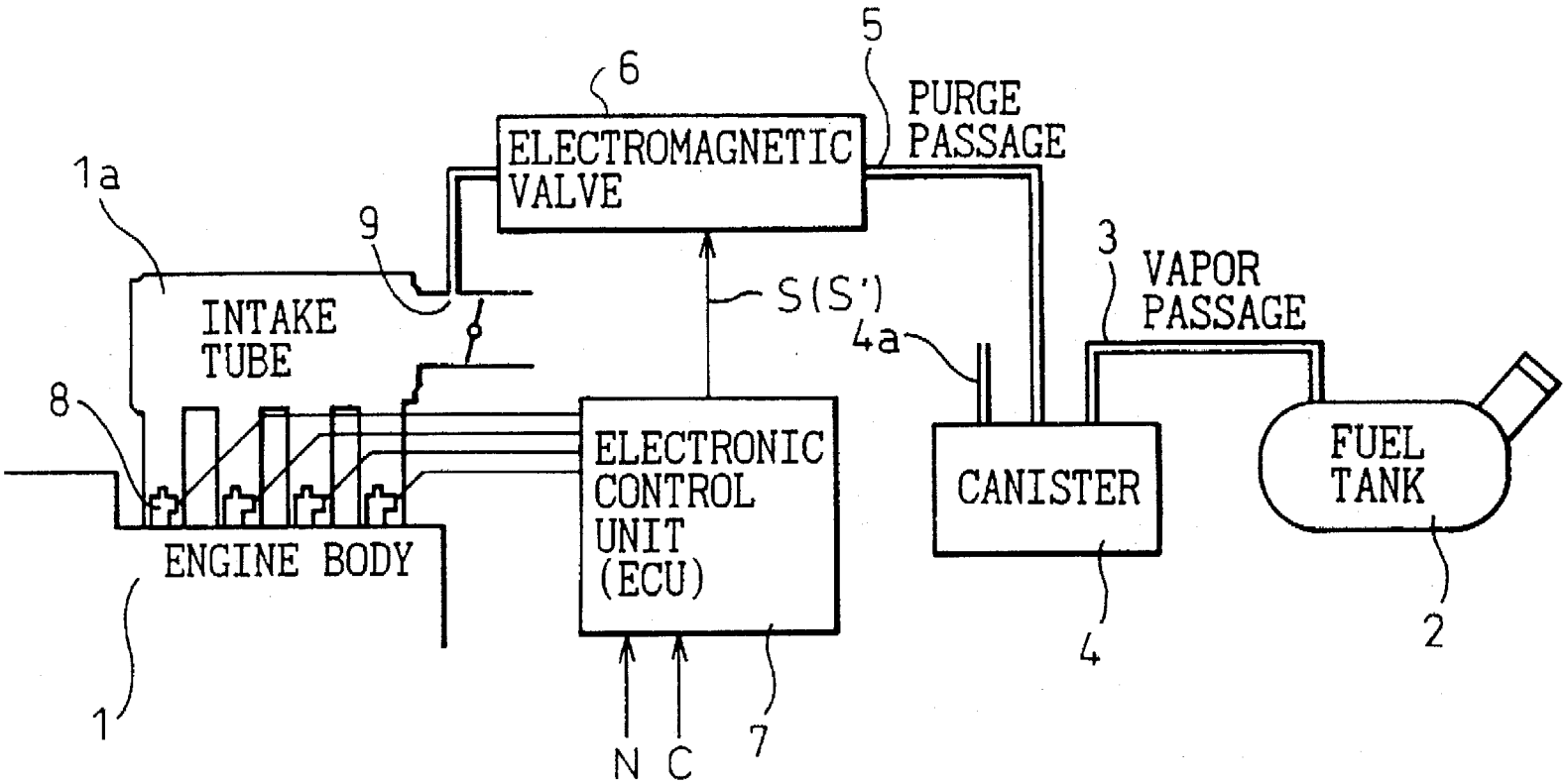
FIG. 2 is an essential structural view of an internal-combustion engine using a vaporized fuel control apparatus according to the present invention.

FIG. 2 is an essential structural view of an internal-combustion engine using a vaporized fuel control apparatus according to the present invention. In FIG. 2, reference number 1 denotes an engine body, 1*a* an intake tube, 2 a fuel tank, 3 a vaporized fuel gas (i.e., vapor) passage, 4*a* an external air port, 4 a canister, 5 a purge passage, 6 an electromagnetic valve (i.e., a purge valve), 7 an electronic control unit, 8 injectors, and 9 a purge port provided in the intake tube 1*a*.

The vapor of the fuel in the fuel tank 2 is introduced to the canister 4 through the vapor passage 3 during driving and stopping, and is absorbed into an activated charcoal (not shown) provided within the canister 4 so that the vapor is temporarily accumulated in the activated charcoal.

The canister 4 is connected to the intake tube 1*a* of the engine body 1 through the purge passage 5, the electromagnetic valve 6 and the purge port 9. In a predetermined driving area of the engine (for example, in a feedback control when a temperature of cooling water is set to 80° C. or more), the air introduced from the air port 4*a* to the canister 4 is absorbed to the intake tube 1*a* by utilizing the intake air having negative pressure. As a result, the vapor absorbed onto the activated charcoal is drawn away therefrom in accordance with the airflow from the air port 4*a*, and introduced to the intake tube 1*a* through the purge port 9 so that the vaporized fuel is purged.

As shown in the drawing, the electromagnetic valve 6, which is used as the purge valve, is provided in the purge passage 5. The electromagnetic valve 6 is periodically turned on/off so as to change the duty ratio so that the purging amount flowing in the purge passage 5 can be controlled. In this case, the duty ratio of the electromagnetic valve 6 is controlled by the electronic control unit 7.

In the electronic control unit 7, many kinds of signals are input thereto in order to control the operation of the engine, for example, (1) a signal detected by a water temperature sensor (not shown) and indicating the cooling water temperature flowing in the engine body 1; (2) an A/F signal detected by an $O_2$ sensor (not shown) mounted on an exhaust passage; (3) a signal detected by an airflow meter and indicating an amount of intake air; (4) a rotational speed signal (N) detected by a crank angle sensor (not shown) and indicating an engine rotational speed; (5) a cylinder distinguishing signal (C) also detected by the crank angle sensor for distinguishing the cylinder. Regarding a signal S generated by this unit 7, this signal S is explained in FIG. 5.

Figure 5:
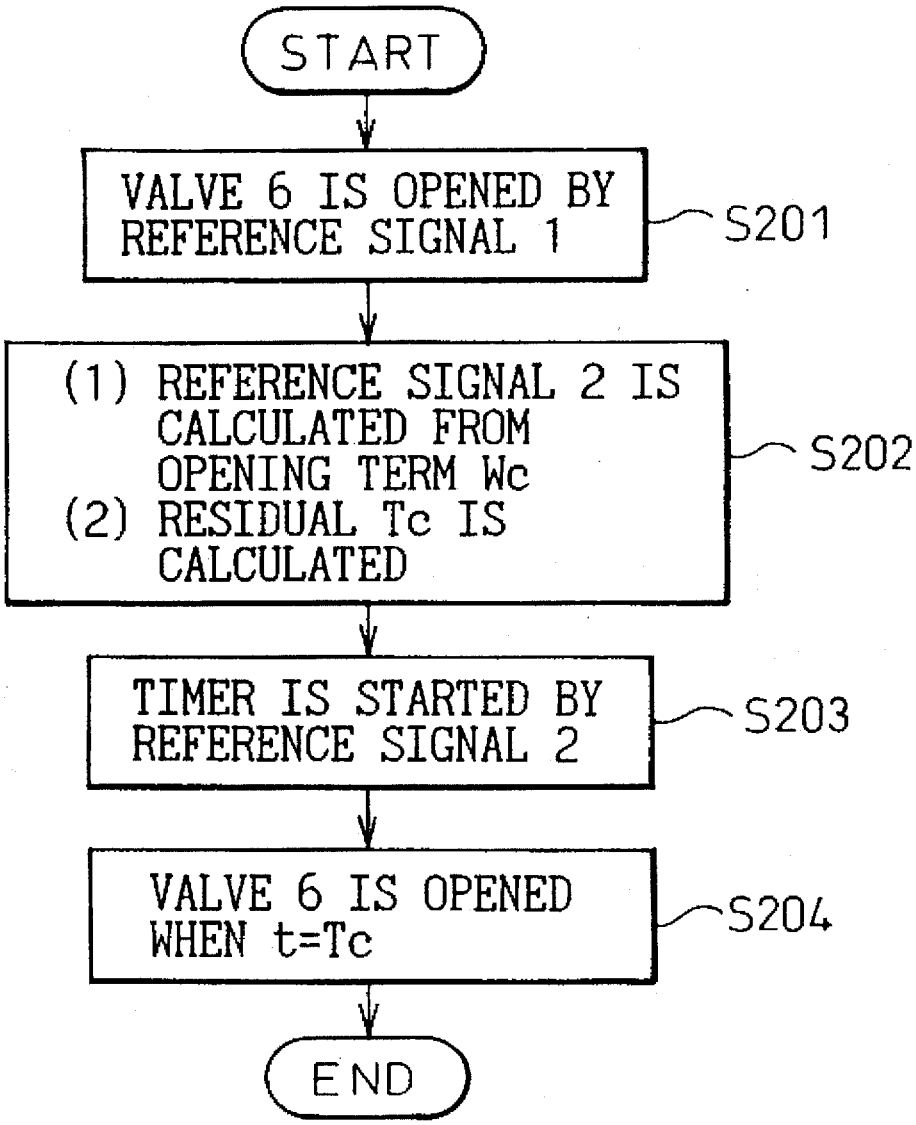
FIG. 5 is a third process flowchart for explaining the operation of the vaporized fuel control apparatus shown in FIG. 2.
Figure 6:
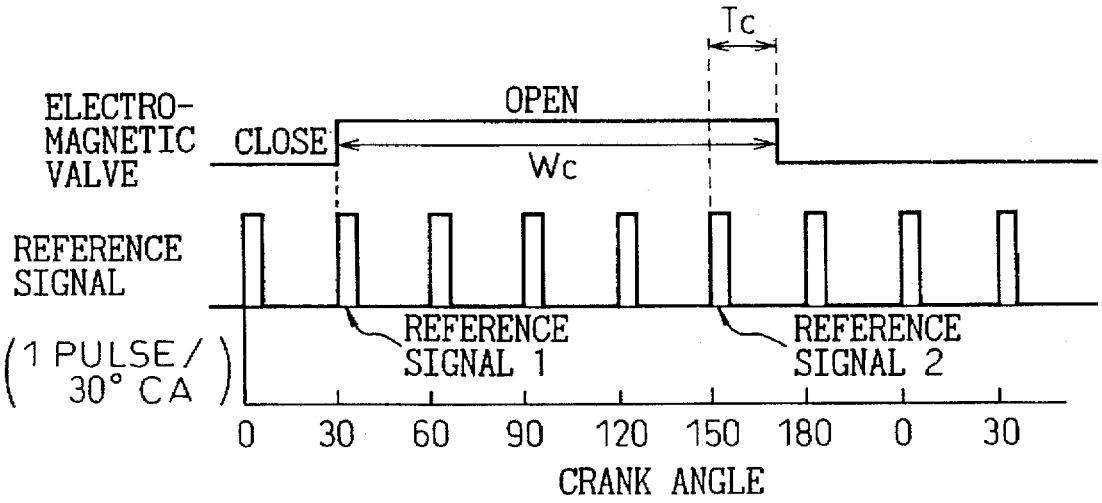
FIG. 6 is a signal timing chart for explaining one example of the operation according to the present invention.

Further, the electronic control unit 7 controls the opening/closing of the electromagnetic valve in accordance with the rotational speed signal N and the cylinder distinguishing signal C (these signals correspond to a reference signal 1 and reference signal 2 as explained in FIGS. 5 and 6). That is, the opening timing of the electromagnetic valve 6 is adapted to the opening timing of the intake valve of the particular cylinder (for example, #1), and is controlled so as to open in accordance with the duty ratio which is set in accordance with the driving condition.

Still further, the electronic control unit 7 acts in such a way that the fuel injecting amount in the intake stroke of the particular cylinder at the opening timing of the electromagnetic valve 6 is corrected so as to reduce the fuel corresponding to absorbed amount of the vapor, and the fuel is injected from the injector 8.

Figure 3:
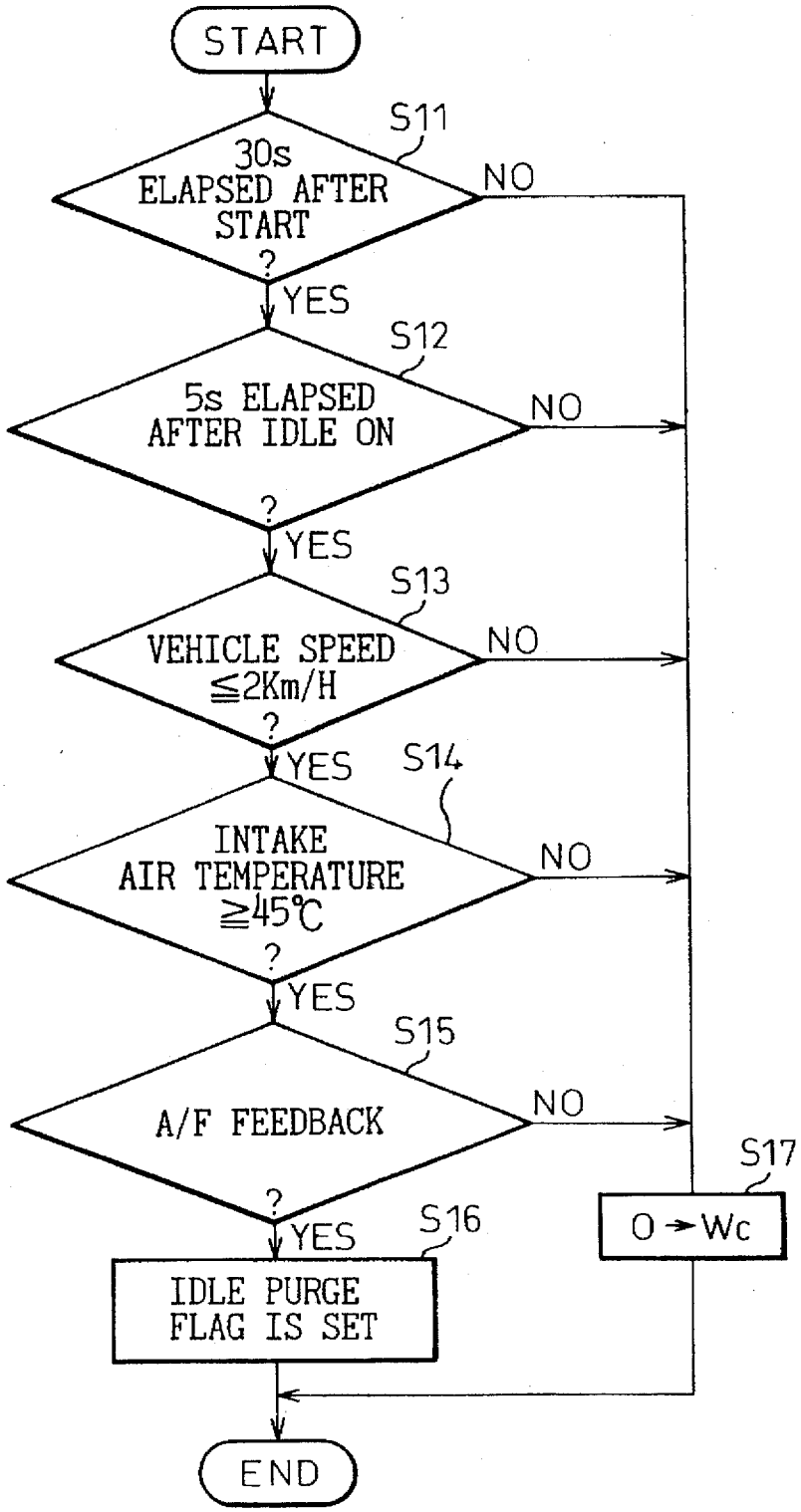
FIG. 3 is a first process flowchart for explaining the operation of the vaporized fuel control apparatus shown in FIG. 2.
Figure 4:
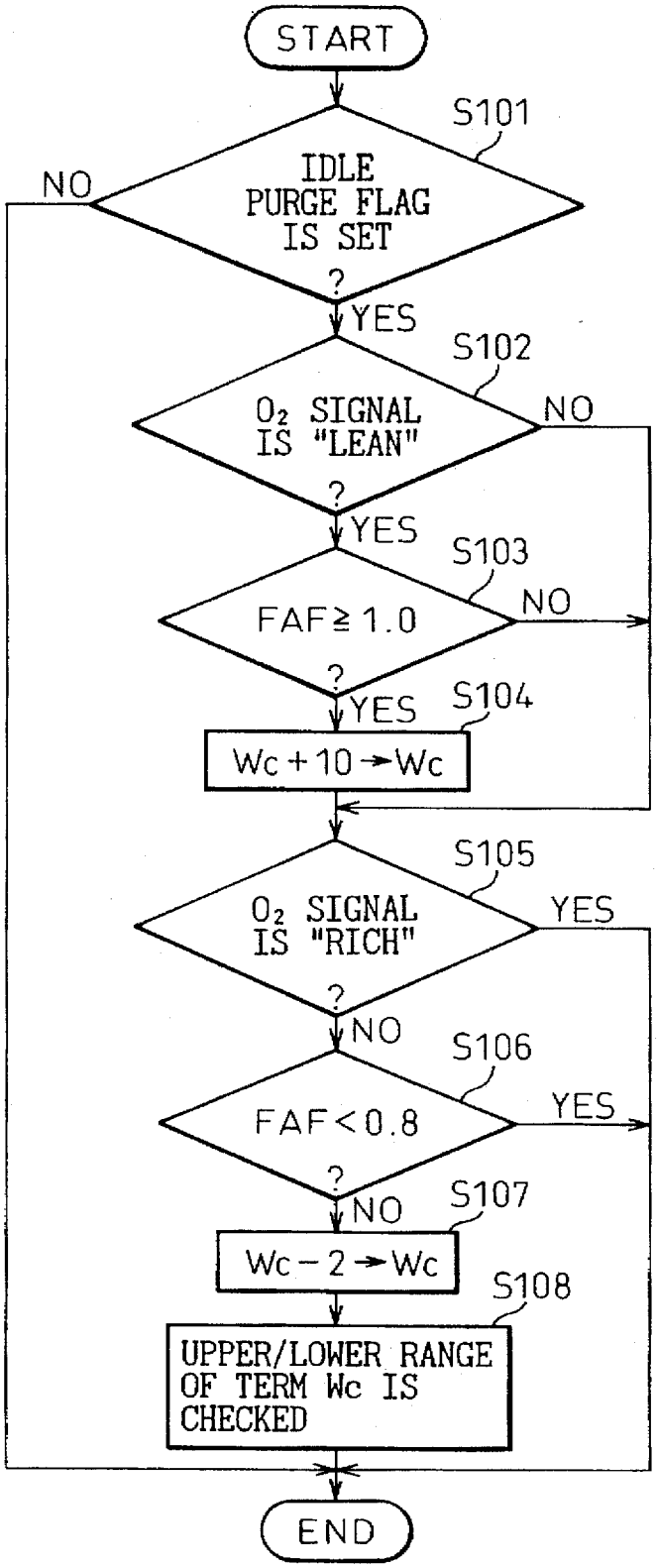
FIG. 4 is a second process flowchart for explaining the operation of the vaporized fuel control apparatus shown in FIG. 2.

FIG. 3 is a first process flowchart for explaining the operation of the vaporized fuel control apparatus shown in FIG. 2, FIG. 4 is a second process flowchart, and FIG. 5 is a third process flowchart.

Concretely, these controls are performed in the electronic control unit 7, and this flowchart explains the steps of checking the conditions for purging the vaporized fuel absorbed into the canister 4.

In FIG. 3, the execution of the purging of the vaporized fuel is set in accordance with the following conditions, i.e., a) Thirty seconds or more have elapsed after the engine 1 was started, and the engine 1 is put in a situation in which the engine rotates stably (YES in step S11).

b) An idling state continues, for example, for five second or more, and this idling state is not an instant idling state at the time of a gear change (step S12).

c) The vehicle speed is, for example, 2 Km/H or less. That is, the vehicle is substantially stopped, and the vehicle speed is not falling (step S13).

d) The temperature of the intake air is, for example, 45° C. or more (step S14).

e) The A/F ratio feedback control is performed in such a way that the fuel injecting amount is reduced by an amount of the vapor added into the intake air (step S15).

After all these conditions are established, an idle purge flag which indicates an index of execution of the purge is set (turned on) (step S16).

However, if any one of conditions as mentioned above is not satisfied (see "NO" through steps S11 to S15), the opening term Wc (this term is calculated by "crank angle") of the electromagnetic valve 6 is set to "0" (step S17). That is, if any one of conditions through step S12 to S15 is not satisfied, the purge of the vapor is not executed during an idling time.

In FIG. 4, this flowchart shows the purge execution routine for the vapor. When a control program is executed for every predetermined time (for example, one second), first, whether the idle purge flag (see step S16 in FIG. 3) is set, is checked (step S101). When the flag is set (YES), the process goes to next step. However, when the flag is reset (NO), the routine is completed.

Next, whether a signal from the $O_2$ sensor ($O_2S$) indicates "lean", is checked (step S102). When the signal is "lean" (YES), whether the A/F feedback correction coefficient (FAF) of the fuel injecting amount (this coefficient is used for control of the fuel injecting valve) is larger than "1.0", is checked (step S103).

When steps S102 and S103 are "YES", since these states indicate an appropriate timing for increasing the fuel amount, the process goes to next step so that "10" is added to the opening term Wc of the electromagnetic valve 6. That is, the opening term Wc is extended to 10° CA in the crank angle (step S104). On the other hand, when steps S102 and S103 are "NO", the step S104 is not executed.

Next, whether the signal from the $O_2$ sensor indicates "rich", is checked (step S105). Further, whether the A/F feedback correction coefficient (FAF) is smaller than "0.8", is checked (step S106).

When steps S105 and S106 are "NO", although it is possible to execute the purge of the vapor, it is determined that an amount of the purge must be reduced so that the opening term Wc of the electromagnetic valve 6 is reduced to 2° CA in the crank angle (step S107).

Further, an upper and lower range of the opening term Wc is checked (step S108). That is, whether the opening term Wc lies in the range from 0° CA to 90° CA of the crank angle, is checked (in this case, an initial value of the opening term Wc is set to 0° CA and the calculation is started from this value).

On the other hand, when steps S105 and S106 are "YES", the opening term Wc is maintained in the present state and the process is completed.

In FIG. 5, this flowchart shows the control routine for driving the electromagnetic valve 6. The electromagnetic valve 6 is driven in accordance with the opening term Wc calculated in the above steps as shown in FIGS. 3 and 4. Further, FIG. 6 is a signal timing chart for explaining the routine of FIG. 5.

In these drawings, a reference signal is generated as one pulse for every 30° of the crank angle CA (one pulse/30° CA). The reference signal 1 indicates the crank angle to open the electromagnetic valve 6, and the reference signal 2 indicates the crank angle just before the electromagnetic valve 6 is closed. In this case, the opening term Wc is not clearly divided by 30° CA so that a residual occurs as shown by Tc. The residual Tc is precisely counted by a timer (not shown) so that the opening term Wc exactly corresponds to the calculated value.

In FIG. 6, the opening timing of the electromagnetic valve 6, for example, the opening timing of the intake valve of the cylinder #1, is adjusted to the pulse generating timing of the reference signal so as not to occur the residual. The electromagnetic valve 6 is opened at the timing of the particular reference signal generating timing (for example, 30° CA of the crank angle) by the reference signal 1, and the opening term Wc is divided by 30° CA so that the number of the pulses (i.e., reference signals) can be counted (150° CA in the crank angle). Further, the residual Tc is counted by the timer in order to obtain the opening timing.

The above steps are shown by the flowchart of FIG. 5. This routine is repeatedly performed at a predetermined time interval in the electronic control unit 7 shown in FIG. 2. As mentioned above, the rotational speed signal N corresponds to the reference signal 1, and the cylinder distinguishing signal C corresponds to the reference signal 2. First, when the electronic control unit 7 receives the reference signal 1, the electronic control unit 7 generates the signal S for opening the electromagnetic valve 6 (step S201). Next, the opening term Wc (crank angle) is divided by 30° CA to obtain the reference signal 2, and the residual Tc is calculated (step S202). When the timer is started when the crank angle corresponds to the position of the reference signal 2, and counts the elapsed time "t" (step S203). When the elapsed time "t" corresponds to the residual Tc, the electronic control unit 7 generates the signal S' to close the electromagnetic valve 6 (step S204).

Figure 7:
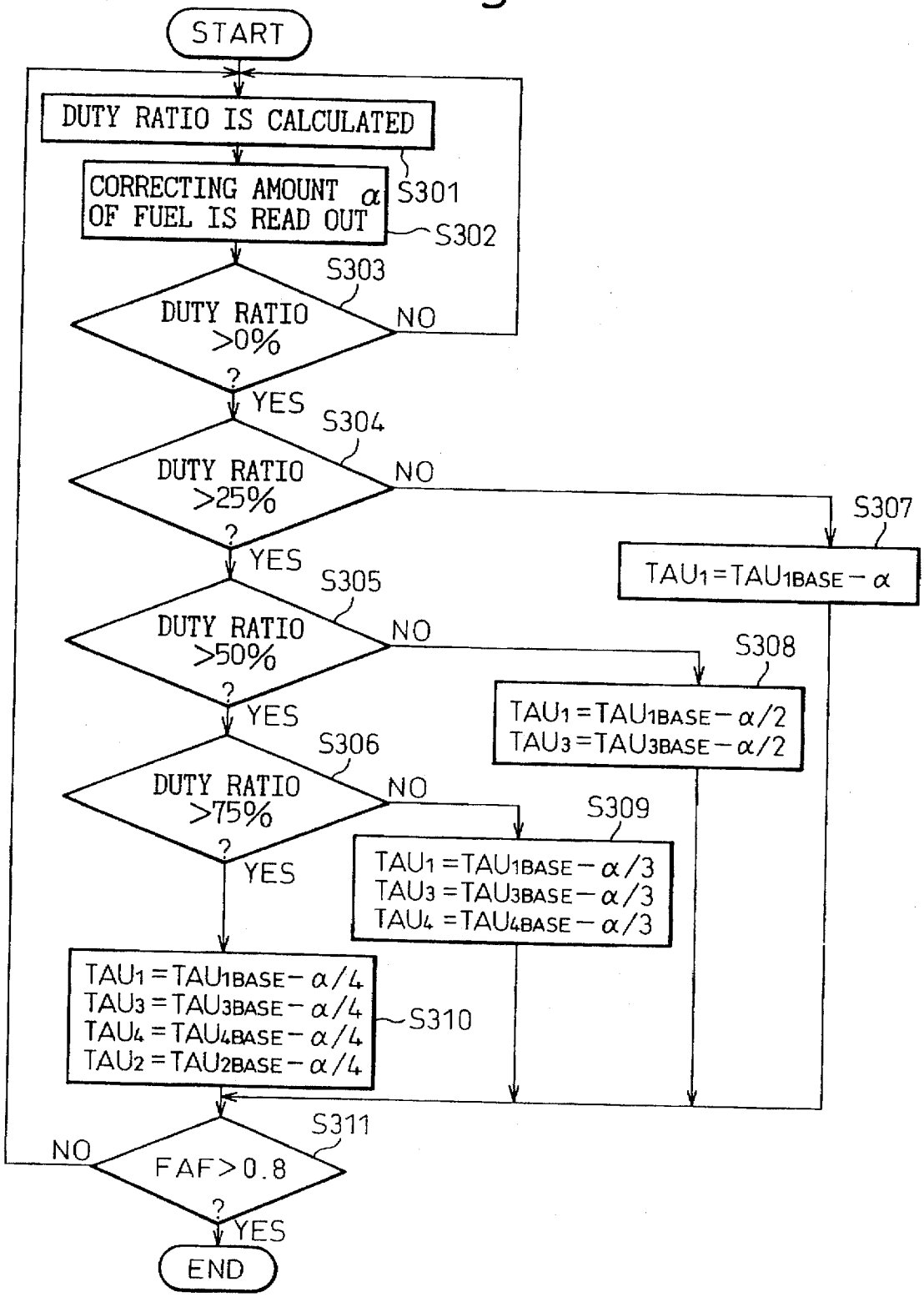
FIG. 7 is a fourth process flowchart for explaining the operation of the vaporized fuel control apparatus shown in FIG. 2.

FIG. 7 is a fourth process flowchart for explaining the operation of the vaporized fuel control apparatus shown in FIG. 2. Concretely, this flowchart shows the control routine for correcting so as to reduce the fuel injecting amount corresponding to the absorbed vapor. In this embodiment, the engine has four cylinders, and the intake stroke of four cylinders is performed in order of #1→#3→#4→#2.

First, the duty ratio of the electromagnetic valve 6 is calculated based on the reference signals 1 and 2 and the opening term Wc (step S301).

Next, the fuel correcting amount $\alpha$ is read out (step S302), and whether the duty ratio is larger than 0%, i.e., whether the purge of the vapor is performed, is checked (step S303). In this case, when the duty ratio is equal to 0% (NO), the process returns to step S301.

On the other hand, when the duty ratio is larger than 0% (YES in step S303), whether the duty ratio is larger than 25%, is checked (step S304). When the duty ratio is smaller than 25% (NO), the fuel correcting amount α is subtracted from the basic fuel injecting amount $TAU_{1BASE}$ of the cylinder #1 (step S307).

When the duty ratio is larger than 25% (YES in step S304), whether the duty ratio is larger than 50%, is checked (step S305). When the duty ratio is smaller than 50% (NO), the fuel correcting amount α/2 is subtracted from the basic fuel injecting amount $TAU_{1BASE}$ of the cylinder #1, and the final fuel injecting amount $TAU_1$ is output (step S308). Further, in this step, the fuel correcting amount α/2 is subtracted from the basic fuel injecting amount $TAU_{3BASE}$ of the cylinder #3, and the final fuel injecting amount $TAU_3$ is output.

When the duty ratio is larger than 50% (YES in step S305), whether the duty ratio is larger than 75%, is checked (step S306). When the duty ratio is smaller than 75%, (NO), the fuel correcting amount α/3 is subtracted from the basic fuel injecting amount $TAU_{1BASE}$ of the cylinder #1, and the final fuel injecting amount $TAU_1$ is output. Further, the fuel correcting amount α/3 is subtracted from the basic fuel injecting amount $TAU_{3BASE}$ of the cylinder #3, and the final fuel injecting amount $TAU_3$ is output. Still further, the fuel correcting amount α/3 is subtracted from the basic fuel injecting amount $TAU_{4BASE}$ of the cylinder #4, and the final fuel injecting amount $TAU_4$ is output (step S309).

When the duty ratio is larger than 75% (YES in step S306), the fuel correcting amount α/4 is subtracted from the basic fuel injecting amount $TAU_{1BASE}$ of the cylinder #1, and the final fuel injecting amount $TAU_1$ is output. Further, the fuel correcting amount α/4 is subtracted from the basic fuel injecting amount $TAU_{3BASE}$ of the cylinder #3, and the final fuel injecting amount $TAU_3$ is output. Still further, the fuel correcting amount α/4 is subtracted from the basic fuel injecting amount $TAU_{4BASE}$ of the cylinder #4, and the final fuel injecting amount $TAU_4$ is output. Still further, the fuel correcting amount α/4 is subtracted from the basic fuel injecting amount $TAU_{2BASE}$ of the cylinder #2, and the final fuel injecting amount $TAU_2$ is output (step S310).

Finally, whether the A/F feedback correcting coefficient FAF is larger than 0.8, is checked (step S311). When the coefficient FAF is larger than 0.8 (YES), the process is completed. When the coefficient FAF is smaller than 0.8 (NO), the process returns to step S301.

Figure 8:
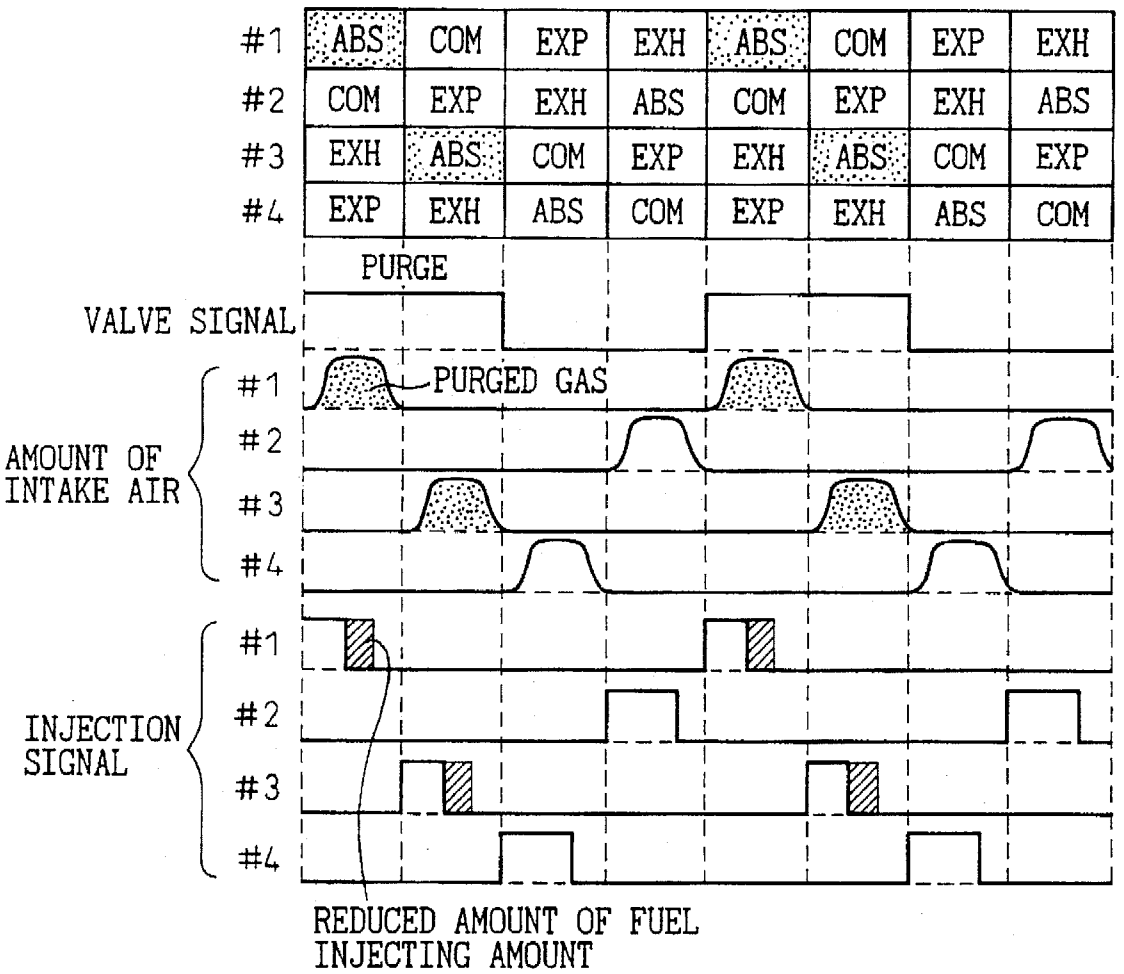
FIG. 8 is a control chart for explaining one example of the operation according to the present invention.

FIG. 8 is a control chart for explaining one example of the operation according to the present invention. In the drawing, ABS denotes an absorption stroke, COM denotes a compression stroke, EXP denotes an explosion stroke and EXH denotes an exhaust stroke. This chart is for a duty ratio of 50% and the particular cylinders are set to the cylinders #1 and #3. That is, in the absorption stroke of these cylinders, the electromagnetic valve 6 is turned on. Since the opening term of the electromagnetic valve 6 is set to the absorption stroke in the cylinders #1 and #3, the purged gas flows into the cylinders #1 and #3.

At that time, the fuel corresponding to an amount of purged gas is corrected for the injection signals #1 and #3 as shown by slanted lines in the injection signals #1 and #3. As a result, the A/F ratio of each cylinder becomes uniform so that it is possible to eliminate misfiring of the engine, an increase of emission of an exhaust gas, etc., caused by the difference between the cylinders even if much vapor is purged.

Although the delay time of the purged gas which remains in the purge passage 5 between the electromagnetic 6 and the engine body 1, is ignored in the above embodiment, it is possible to easily solve this delay time problem by adjusting the opening timing of the electromagnetic valve 6 so as to correspond to the delay time.

Further, only the fuel injecting amount for the cylinder which is performing the intake stroke at the opening timing of the electromagnetic valve, is corrected in this embodiment. However, since the vapor is diffused in a surge tank so that a small amount of the vapor flows to another cylinder, it is possible to change the correcting amount of the fuel in such a way that the reduced amount of the fuel for the cylinder which is performing the intake stroke at the opening timing of the electromagnetic valve, becomes large, and the reduced amount of the fuel for other cylinders becomes small.

We claim:

1. A vaporized fuel control apparatus in an internal-combustion engine at least including a plurality of cylinders and each cylinder having a fuel injector, an intake tube mounted to said cylinders, a fuel tank, and a canister connected to said fuel tank, comprising:

a purge valve provided in a purge passage connected between said canister and intake tube, and said canister being filled by an absorbing material to absorb a fuel vaporized from said fuel tank; and a control means for controlling an amount of purged gas flowing into said intake tube by controlling the opening/closing timing and the duty ratio of said purge valve in such a way that said purge valve is opened at a timing when a stroke of a particular cylinder reaches the same stroke at a next cycle in synchronization with an engine rotational speed, and an supplying amount of the fuel to said particular cylinder is reduced in accordance with an amount corresponding to an inflow amount of said purged gas.

2. A vaporized fuel control apparatus as claimed in claim 1, wherein said duty ratio is controlled so as to obtain an optimum inflow amount of the purged gas.

3. A vaporized fuel control apparatus as claimed in claim 1, wherein said cylinders are formed by four cylinders #1 to #4, and said particular cylinder is defined as the cylinder #1.

4. A vaporized fuel control apparatus as claimed in claim 3, wherein said particular cylinder is defined as the cylinders #1 and #3.

5. A vaporized fuel control apparatus as claimed in claim 1, wherein said stroke is defined as an absorption stroke.

6. A method for controlling vaporized fuel in an internal-combustion engine at least including a plurality of cylinders and each cylinder having a fuel injector, an intake tube mounted to said cylinders, a fuel tank, and a canister connected to said fuel tank, comprising the steps of:

providing a control means for controlling an amount of purged gas flowing into said intake tube by controlling the opening/closing timing and the duty ratio of said purge valve; and controlling said purge valve by said control means in such a way that said purge valve is opened at a time when a stroke of a particular cylinder reaches the same stroke at a next cycle in synchronization with an engine rotational speed, and an supplying amount of the fuel to said particular cylinder is reduced in accordance with an amount corresponding to an inflow amount of said purged gas.

7. A method for controlling vaporized fuel as claimed in claim 6, wherein said duty ratio is controlled so as to obtain an optimum inflow amount of the purged gas.

* * * * *